US009908170B2

(12) United States Patent
Roy et al.

(10) Patent No.: US 9,908,170 B2
(45) Date of Patent: Mar. 6, 2018

(54) BLADE FOR AXIAL COMPRESSOR ROTOR

(71) Applicants: Indian Institute of Technology, Bombay, Maharashtra (IN); Pratt & Whitney Canada Corp, Longueuil (CA)

(72) Inventors: Bhaskar Roy, Kolkata (IN); Pradeep M. Amboor, Mumbai (IN); Chaitanya V. Halbe, Mumbai (IN); Hong Yu, Mississauga (CA); Peter Townsend, Mississauga (CA)

(73) Assignees: INDIAN INSTITUTE OF TECHNOLOGY, BOMBAY, Maharashtra (IN); PRATT & WHITNEY CANADA CORP., Quebec (CA)

( * ) Notice: Subject to any disclaimer, the term of this patent is extended or adjusted under 35 U.S.C. 154(b) by 417 days.

(21) Appl. No.: 14/317,354

(22) Filed: Jun. 27, 2014

(65) Prior Publication Data

US 2015/0219115 A1 Aug. 6, 2015

(30) Foreign Application Priority Data

Feb. 3, 2014 (IN) ..... 371/MUM/2014

(51) Int. Cl.
*B21D 53/78* (2006.01)
*B21D 11/14* (2006.01)
(Continued)

(52) U.S. Cl.
CPC ..... *B21D 53/78* (2013.01); *B21D 11/14* (2013.01); *F01D 5/141* (2013.01); *F04D 29/324* (2013.01);
(Continued)

(58) Field of Classification Search
CPC . F01D 5/141; F01D 5/14; F01D 5/143; B21D 53/78; F04D 29/324;
(Continued)

(56) References Cited

U.S. PATENT DOCUMENTS 5,167,489 A 12/1992 Wadia et al.
8,133,012 B2 * 3/2012 Nagai ..... F01D 5/141 415/149.1
(Continued)

FOREIGN PATENT DOCUMENTS

EP 1333181 A1 8/2003
EP 1505302 A1 2/2005
EP 1930598 A2 6/2008

OTHER PUBLICATIONS

European Search Report for European Patent Application No. 15153485.6, dated Oct. 15, 2015.

*Primary Examiner* — Richard Edgar
*Assistant Examiner* — John S Hunter
(74) *Attorney, Agent, or Firm* — Bachman & LaPointe, P.C.

(57) ABSTRACT

A blade for a compressor rotor including a blade root at a first end of the blade connected to the compressor rotor and a blade tip extending from second end of the blade. The blade tip extends up to 20% of a span of the blade from the second end towards the first end. The blade tip is disposed such that a first segment of the blade tip defines a positive dihedral angle and a second segment of the blade tip defines a negative dihedral angle. The positive and negative dihedral angles defining a twist of the blade tip relative to the face of the blade, wherein the blade remains untwisted along the span from outside of the blade tip.

18 Claims, 9 Drawing Sheets

(51) Int. Cl.
*F04D 29/32* (2006.01)
*F01D 5/14* (2006.01)
*F04D 19/02* (2006.01)

(52) U.S. Cl.
CPC ..... *F04D 19/02* (2013.01); *F05D 2250/71* (2013.01); *Y10T 29/49336* (2015.01)

(58) Field of Classification Search
CPC .. F04D 29/2216; F04D 29/242; F04D 29/386; F04D 29/544
See application file for complete search history.

(56) References Cited

U.S. PATENT DOCUMENTS

| | | | | |
|---|---|---|---|---|
| 8,177,496 | B2 * | 5/2012 | Wilson | F01D 5/141 415/181 |
| 8,360,729 | B2 * | 1/2013 | Yagami | B21D 22/02 416/185 |
| 8,382,438 | B2 | 2/2013 | Guemmer | |
| 8,684,698 | B2 * | 4/2014 | Breeze-Stringfellow | F01D 5/141 416/223 A |
| 8,715,556 | B2 * | 5/2014 | Murakami | B29C 70/30 264/258 |
| 2010/0111674 | A1 | 5/2010 | Sparks | |
| 2012/0243975 | A1 | 9/2012 | Breeze-Stringfellow et al. | |

* cited by examiner

BLADE FOR AXIAL COMPRESSOR ROTOR

CROSS-REFERENCE TO RELATED APPLICATIONS

This application claims priority to Indian application No. 371/MUM/2014, the entire contents of which are incorporated by reference herein.

TECHNICAL FIELD

The present invention in general relates to blades in axial flow fans and compressors.

BACKGROUND OF THE ART

An axial compressor is typically made up of many alternating rows of rotating and stationary blades called rotors and stators, respectively. The first stationary row (which comes in front of the rotor) is typically called the inlet guide vanes or IGV. Each successive rotor-stator pair is called a compressor stage and hence, compressors with several such blade rows are termed as 'multistage compressors'.

In existing axial flow fan/compressor rotor blades, the entire tip is leaned (dihedral) in only one direction and an additional lean or bow or dihedral is provided to obtain better aerodynamic efficiency of the blade operation.

However the existing blade designs do not solve the problem of tip gap sensitivity to gap enlargement and the compressor performance is affected by increase in tip gap. During actual operation of the rotor blade, the gap between the rotor tip and the casing changes (often increases) due to various thermal and mechanical stresses. Hot air/gas flowing through the structure expands the casing differentially with respect to the blades and there is continuous gap change taking place during an operational phase of the compressor. When the compressor stops running, the structure cools down relieving the mechanical stresses and the gap reverts to its original value. Thus, the gap is dependent on prevailing (operational) mechanical stresses and thermal expansion of the rotor blade and the casing.

SUMMARY

In one aspect, there is provided a blade for a compressor rotor comprising: a blade root at a first end of the blade connectable to the compressor rotor; and a blade tip at a second end of the blade, the first end and the second end defining a span of the blade, the blade root and the blade tip forming a face of the blade between them, the blade tip comprising a first extremity and a second extremity; the blade tip being disposed such that a first segment of the blade tip defines a positive dihedral angle relative to the face of the blade, the first segment extending from a first point in the blade tip to the first extremity of the blade tip, and a second segment of the blade tip defining a negative dihedral angle relative to the face of the blade, the second segment extending from a second point in the blade tip to the second extremity of the blade tip.

In yet another aspect, there is provided a method for making a blade for a compressor rotor, the blade having a first edge and a second edge, the method comprising the steps of; twisting the width of the blade between the first edge and a pre-determined first point near a middle of the blade in a first direction over an area of the blade disposed at up to 20% of span of blade from the second end of the blade, and twisting the width of blade between the second edge and a pre-determined second point near the middle of the blade in a second direction over the area of the blade disposed at up to 20% of span of blade from the second end of the blade, resulting in forming a split dihedral surface at a blade tip region.

In yet another aspect, there is provided a compressor rotor comprising: a plurality of blades including: a blade root at a first end of the blade connectable to the compressor rotor; and a blade tip at a second end of the blade, the first end and the second end defining a span of the blade, the blade root and the blade tip forming a face of the blade between them, the blade tip comprising a first extremity and a second extremity; the blade tip being disposed such that a first segment of the blade tip defines a positive dihedral angle relative to the face of the blade, the first segment extending from a first point in the blade tip to the first extremity of the blade tip, and a second segment of the blade tip defining a negative dihedral angle relative to the face of the blade, the second segment extending from a second point in the blade tip to the second extremity of the blade tip.

BRIEF DESCRIPTION OF THE DRAWINGS

Reference is now made to the accompanying figures in which.

DETAILED DESCRIPTION

Figure 1:
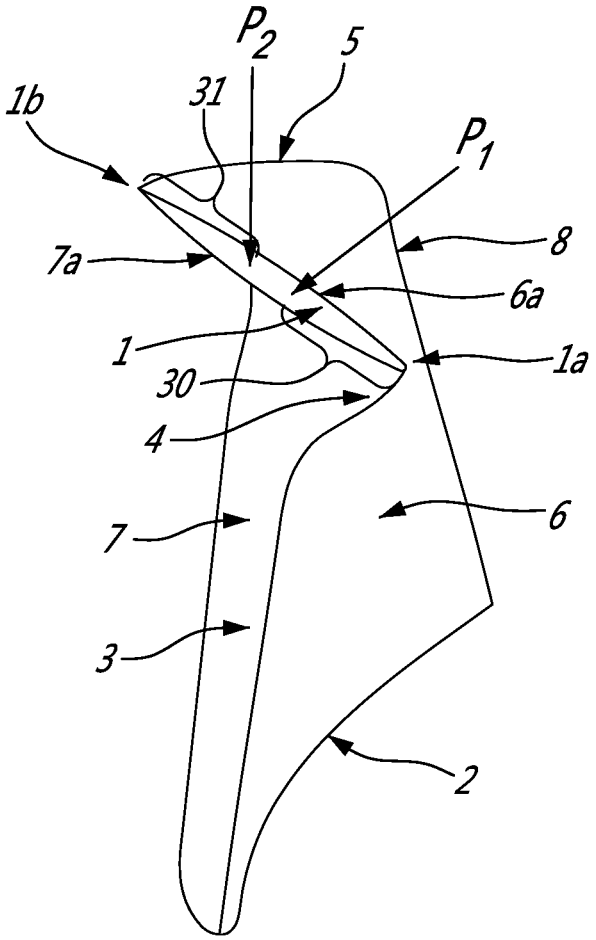
FIG. 1 shows a perspective view of a rotor blade according to one embodiment having a split dihedral tip.

FIG. 1 illustrates generally a blade having a blade root 2 at a first end thereof, and a blade tip 1 at a second end thereof. The blade root 2 is attachable to a body of the compressor rotor. The first end and the second end are disposed on a span of the blade. The blade root 2 and the blade tip 1 define a face of the blade between them. The blade tip 1 includes a first extremity 1*a* and a second extremity 1*b*. The face of the blade has a first surface or suction surface 7 and a second surface or pressure surface 6. The first surface 7 is convex shaped and the second surface 6 is concave shaped. The face of the blade also has a first edge commonly referred as leading edge 3 and a second edge commonly referred as trailing edge 8 such that the first edge 3 and the second edge 8 define a width of the blade between them. The width is orthogonal to the span and the first edge 3 and the second edge 8 are offset with respect to the face of the blade. When in use, the first edge 3 is disposed upstream from the second edge 8. The proposed axial compressor rotor blade 9 (FIG. 2) has a split dihedral tip, meaning that the dihedral is split in two parts, a front part and a rear part, each part having opposite (i.e. positive and negative) lean or dihedral. The tip region 1 of the blade for compressing the air flow is shown in FIG. 1 to have positive dihedral 4 in the front part and a negative dihedral 5 in the rear part. Half of the tip region is twisted front and other half of the tip region is twisted back giving the split dihedral shape to tip. The blade tip 1 is disposed such that a first segment 30 of the blade tip defines a positive dihedral angle relative to the face of the blade. The first segment extends from a first point P1 in the blade tip to a first extremity 1*a* of the blade tip 1. A second segment 31 of the blade tip 1 defines a negative dihedral angle relative to the face of the blade. The second segment extends from a second point P2 in the blade tip 1 to a second extremity 1*b* of the blade tip 1.

The blade root 2 may be fitted to a disk 22 (FIG. 2) of the rotor in a slotting arrangement for coupling the blade root 2 to the compressor disk rotor. The blade root 2 may also be welded to the disk rotor to create integrally bladed rotor (IBR) entity, often known as blisk. The blade and the disk rotor may also be fabricated integrally. The slotting arrangement may comprise a groove or slot in the compressor rotor and a projection in the blade. The projection can be slid into the groove for coupling. The sliding of the blade into the groove of the compressor rotor is done in a direction parallel to an axis of the compressor rotor. The skilled reader will also appreciate, in light of this description, that the present disclosure may also be applied to integrally bladed rotors (IBRs), in which the rotor hub and blades are provided as a monolithic component.

Referring still to FIG. 1, the two sides of the blade have two surfaces dissimilar to each other. The first surface 7 and the second surface 6 together also form an airfoil at any cross section 33 of the blade. These airfoiled shaped cross-sections are in a stacking relationship with each other. In other words, the cross-sections formed by the first surface 7 and the second surface 6 are virtually stacked or parallel to each other, similarly to as layers adjacent each other. By "virtually stacked" one should understand that the cross-sections are not stacked when manufactured, but rather the stacking relationship is for describing the physical details of the blade. The blade tip 1 also has an airfoil shape with a suction side 7*a* and a pressure side 6*a*. In one embodiment, on approximately the first 80% of the blade span starting from the root 2 of the blade, cross sections of the blade are airfoil shaped. Each airfoil is identified with a suction side with a higher curvature, a pressure side with lesser curvature, a leading edge with higher curve at one extremity of blade and a trailing edge with less curve at another extremity of the blade. However, the cross sections that are disposed at about 80% to 99% of the blade's span (i.e. about one-fifth or 20% of the span), may not have this classic feature of an airfoil shape. These cross sections progressively morph due the additional twist applied in the region toward the blade tip 1. Yet the blade tip 1 has an airfoil shape. The continuous change of the cross sections, wherein the cross-sections may lose their airfoil shape and regain it at the tip, is a feature of one aspect of the present blade. However, in another aspect, the cross-sections may retain an airfoil shape throughout the blade through the split dihedral region. Either way, a split dihedral shape can be provided—positive dihedral 4 in one direction in the front part and negative dihedral 5 in second direction in the rear part.

Figure 2:
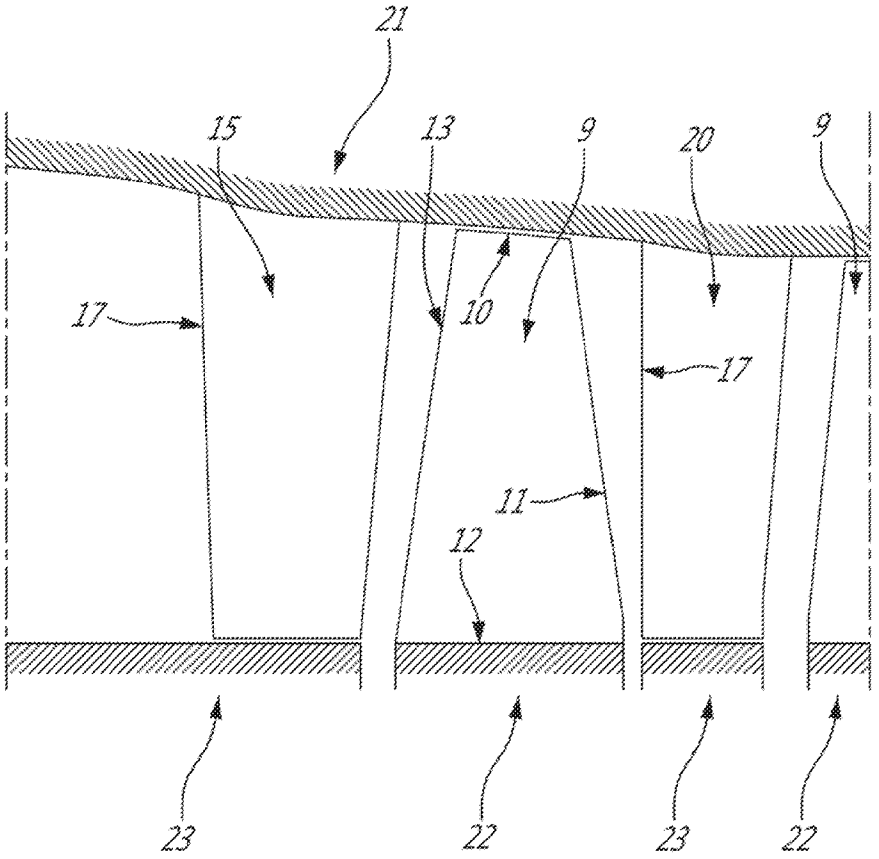
FIG. 2 shows a side view of a rotor and a stator embedded inside a multistage arrangement.

FIG. 2 illustrates the arrangement of a typical axial flow compressor, consisting of a rotor blade 9, stator blade 20, an inlet stator blade (or inlet guide vane) 15 which can be the stator blade of the preceding stage. The rotor blade has a root 12 attached to a disk 22 and a tip 10 which keeps a gap with the casing 21. The rotor blade has a leading edge 13 which faces the air flow and a trailing edge 11 from which the flow leaves the blade to proceed to the next stator blade 20, where the leading edge 17 meets the flow first. The stator blade 20 may or may not have a gap between the stator tip and the hub 23. The dimensions of a rotor blade may be decided based on aerodynamic design principles, which generally requires that the succeeding stages have smaller blades, both in blade length (commonly referred as span or height), and in blade width (commonly referred as airfoil chord). The blade tip has positive lean (or dihedral) from one extremity 1*a* to half of the chord, forming one segment, and negative (lean or dihedral) from a second extremity 1*b* to half of the chord forming another segment.

Figure 3C:
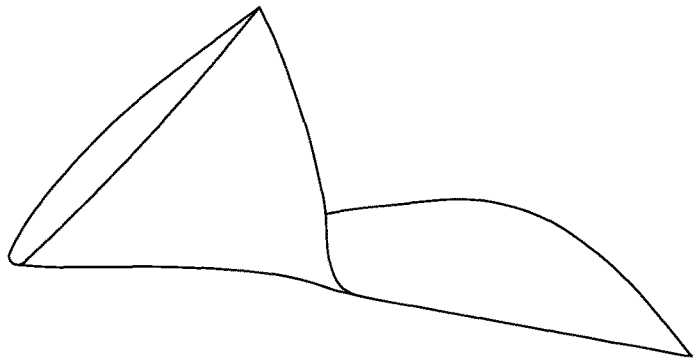
FIGS. 3A to 3C show a conventional rotor blade (FIG. 3A) and two embodiments of tip re-shaping (FIGS. 3B and 3C)
Figure 3B:
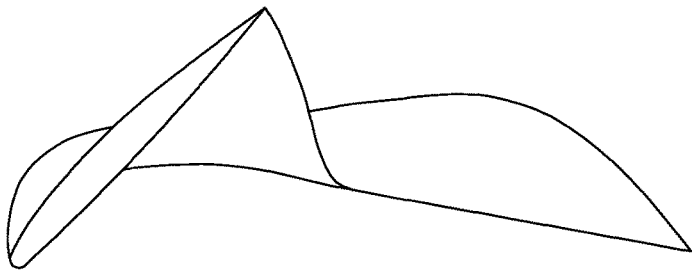
Figure 3A:
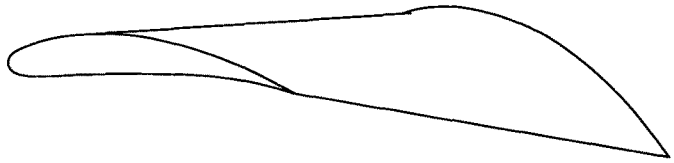

FIGS. 3A, 3B, 3C illustrate a conventional rotor blade (FIG. 3A) in comparison with two tip re-shaped rotor blades (FIGS. 3B and 3C). In case of both FIG. 3A and FIG. 3B, the centre of gravity 32 of all the airfoils belong to a radial line from the root to the tip of the blade. The radial line is disposed midway of the chords of blade. In case of FIG. 3C the leading edges of all the airfoils from the root to the tip are held in one straight line.

Figure 4C:
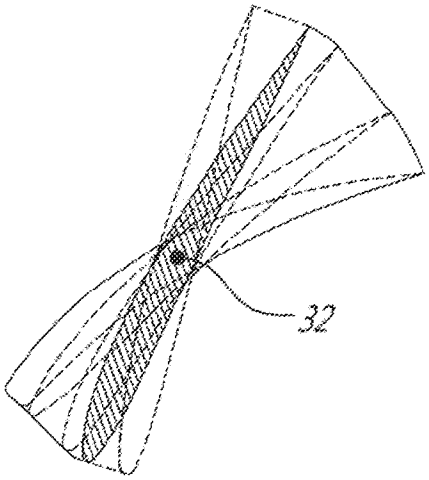
FIGS. 4A to 4C show top views of three blades illustrating three different ways of tip re-shaping, FIG. 4A being the top view of the blade shown in FIG. 3C and FIG. 4C being the top view of the blade shown in FIG. 3B.
Figure 4B:
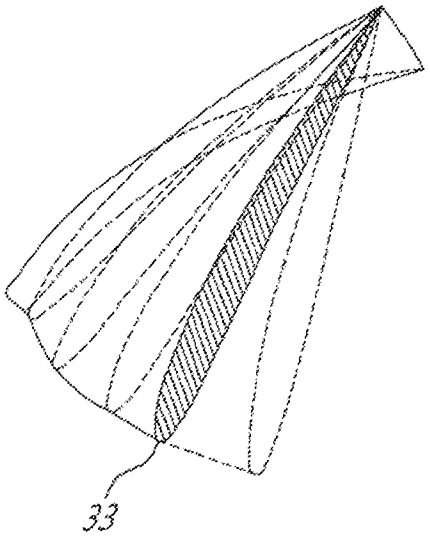
Figure 4A:
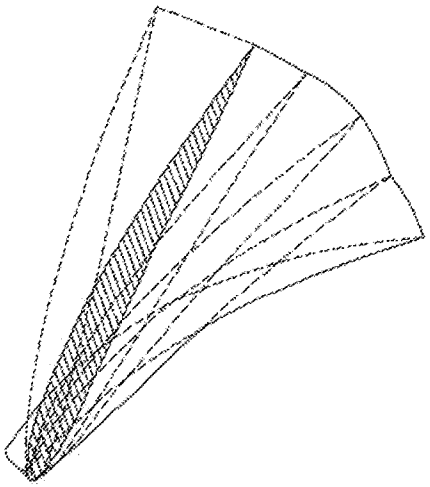

FIGS. 4A to 4C shows top views of a blade and illustrates three possible different methods by which the blade tip can be re-shaped or tailored, though the skilled reader will appreciate that other variations are also possible and that any suitable stacking may be employed without departing from the scope of the present disclosure.

FIG. 4A shows the blade in which the leading edges of the all the airfoils from the root to the tip are held in one straight line. FIG. 4B shows the blade in which the trailing edges of the all the airfoils from the root to the tip are held in one straight line. FIG. 4C shows the blade in which the centers of gravity of all the airfoils from the root to the tip are held in one straight line. The proposed blade shown in FIG. 4C has a plurality of airfoiled shaped cross-sections along the face of the blade and wherein centre of gravity 32 of the plurality of airfoils are collinear and runs through a middle of the blade over the entire span of the blade. In all the cases of FIG. 4 the top 20% of the blade have been differently twisted. FIG. 4A is the top view of the blade 3C and FIG. 4C is the top view of the blade in FIG. 3B.

Figure 5C:
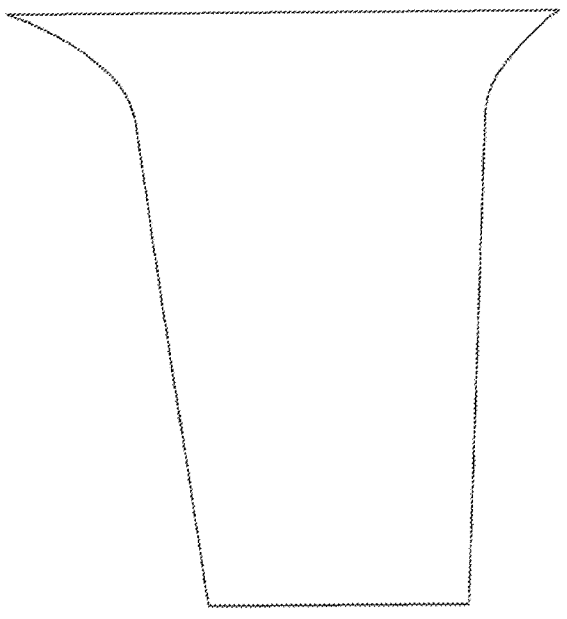
FIGS. 5A to 5C show three views of the blade shown in FIG. 3C.
Figure 5B:
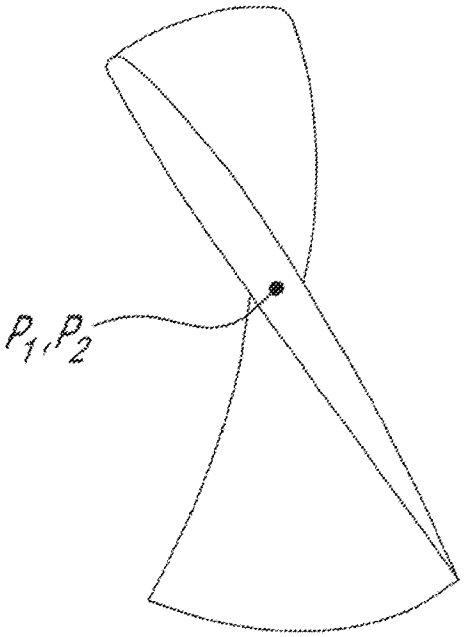
Figure 5A:
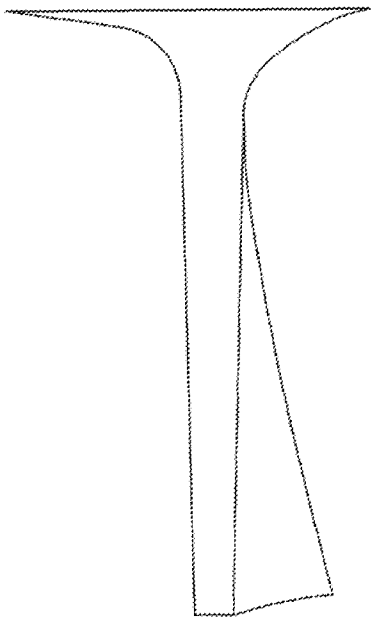

FIGS. 5A to 5C illustrates three views of the blade shown in 3B and 4C. FIG. 5A shows the view from the leading edge showing the tip zone with front part leaning to the right and the rear part leaning to the left. FIG. 5B shows the top view of the same blade. FIG. 5C shows the side view of the blade. The proposed blade shown in FIGS. 5A to 5C has been made by twisting the width of blade between the first edge and the centre of gravity of blade in a first direction towards second surface of compressor blade and again by twisting the width of blade between the second edge and the centre of gravity of blade in a second direction towards first surface of compressor blade thereby forming a split dihedral surface at the blade tip region.

Figure 6C:
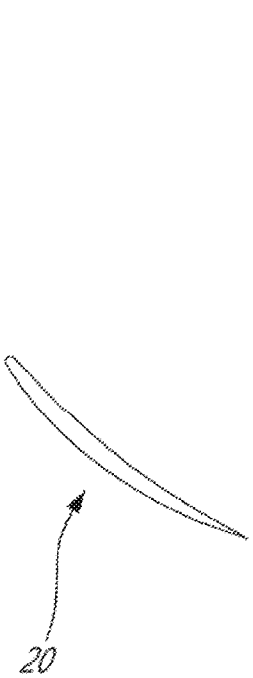
FIGS. 6A to 6C show a conventional tip airfoil modified to create a design matching with a preceding inlet guide vane and a succeeding stator blade.
Figure 6B:
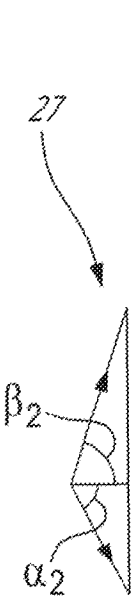
Figure 6B:
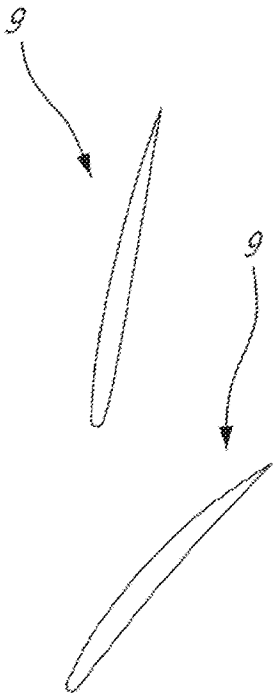
Figure 6A:
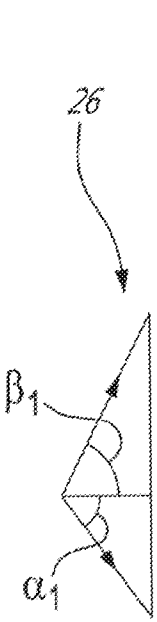
Figure 6A:
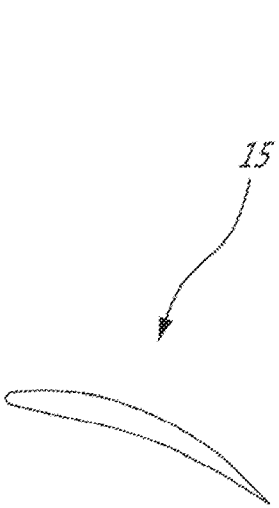

FIGS. 6A to 6C illustrates the blade tip airfoil sections of IGV (inlet guide vane) 15, rotor 9 and stator 20 blades. FIG. 6A, left side, show the IGV 15 tip airfoil, and FIG. 6A, right side, a velocity triangle 26 shows that the flow as coming out of the IGV 15 at an angle α1. The angle β1 is the angle which has been re-arranged to meet the new rotor tip airfoil 10 as in FIG. 6B top figure from the original tip airfoil in FIG. 6B bottom figure. The velocity triangle 26 represents the matching between the stationary IGV 15 and the rotating rotor blade tip 10. FIG. 6C shows a rotor tip airfoil 10 and a velocity triangle 27. The velocity triangle 27 shows the rotor tip flow exiting at angle β2 adjusted to the stationary stator blade tip airfoil to which the flow is now entering at the angle α2. In designing the new tip tailored blade only the angles β1 and β2 have been rearranged to create the split-dihedral blade tip shape. The flow angles α1 and α2 have been unchanged to match with the pre-existing IGV and stator blades. This matching is done for all the airfoils in the top 20% of the rotor blade. The matching between the IGV and rotor on one hand and between rotor and stator on another hand may provide good aerodynamic performance of the compressor stage.

Figure 7:
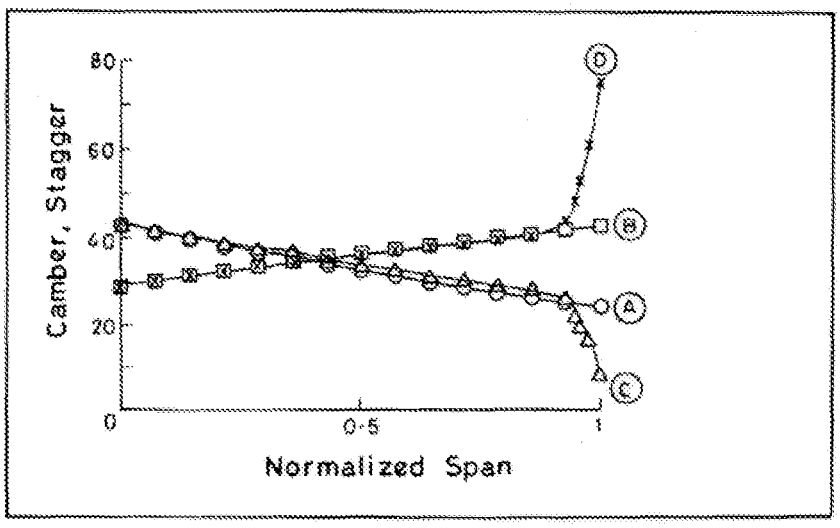
FIG. 7 shows variations of camber and stagger for the blades before and after the tip shape modification.

FIG. 7 illustrates the variation of camber and stagger from the root to the tip of the rotor blade. The cases (A) and (B) show the variation in camber and stagger for an original rotor blade. The cases (C) and (D) show the variation in camber and stagger for a split-dihedral rotor blade. The change in angles between the original and split-dihedral tip as shown here may be higher that can be recommended for some blade designs. In some cases, actual angle variations may be far less than what is shown here.

Figure 8:
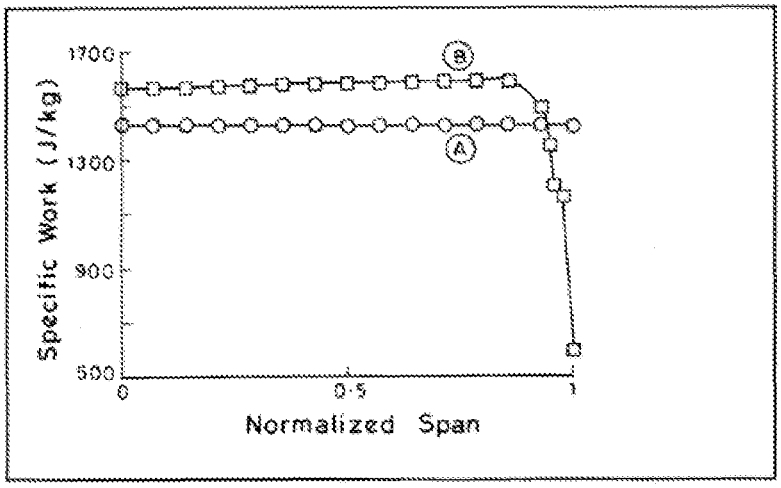
FIG. 8 shows the variation of specific work (work done per unit mass) along the blade length (or span)—before and after the tip modification.

FIG. 8 illustrates the variation in sectional work done by the airfoils from the root to the tip of the rotor blade. The sharp dip in the work done at the tip region of the split-dihedral blade (B) compared to the original blade (A) is by design. In this design to compensate for this loss of work at the tip region the blade from root to 80% span is made to do more work—so that the total work done is of the same order as that of the original rotor blade. This provides a methodology and proof that rotor blades can be tip-tailored without loss of total work done capability.

Figure 9:
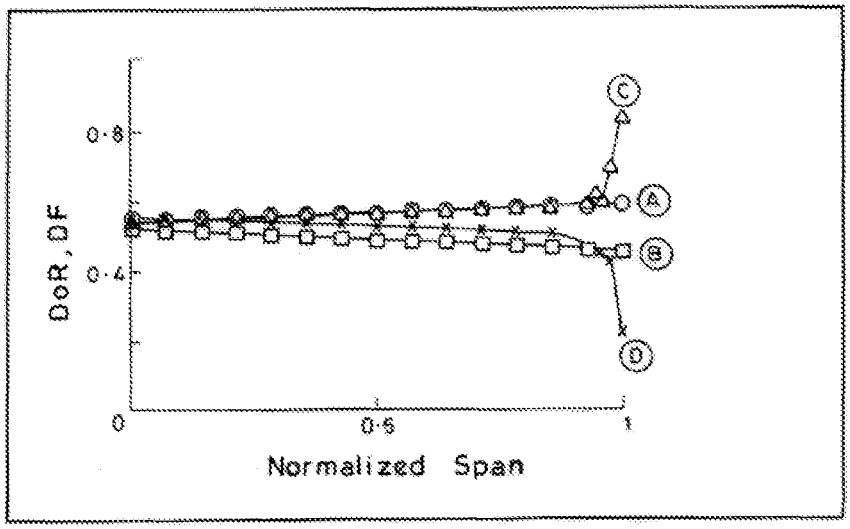
FIG. 9 shows the variation of degree of reaction and diffusion factor the blade length—before and after the modification.

FIG. 9 illustrates the variation in two typical figures of merit used for evaluating compressor blade aerodynamic loading capability. Both the parameters are defined to show loading on any specific airfoil at any rotor blade section. FIG. 9 shows the variation in Degree of Reaction (A) and Diffusion factor (B) of the original rotor blade sections. The variation of the same parameters for the split-dihedral blade is shown in graph (C) and (D) respectively.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

What is claimed is:

1. A blade for a compressor rotor comprising:

a blade root at a first end of the blade connectable to the compressor rotor; and a blade tip extending from a second end of the blade towards the first end, the first end and the second end defining a face of the blade between them, the face extending chordally between a first extremity and an opposite second extremity along a chord of the blade, a span of the blade extends between the first end and the second end, the blade tip extending up to 20% of the span from the second end towards the first end, a first segment of the blade tip extending from the first extremity to a first position along the chord, a second segment of the blade tip extending from the second extremity to a second position along the chord, the first segment defining a positive dihedral angle at the second end and the second segment defining a negative dihedral angle at the second end relative to the face of the blade, the positive and negative dihedral angles defining a split dihedral twist relative to a conventional rotor blade, wherein the blade is defined by the conventional rotor blade along the entire span outside of the blade tip.

2. A blade as claimed in claim 1, wherein the first position and the second position are a same position.

3. A blade as claimed in claim 1, wherein the face of the blade includes a first surface and a second opposed surface, the first surface is convex shaped and the second surface is concave shaped.

4. A blade as claimed in claim 3, wherein the face of the blade includes a first edge and a second edge, the first edge and the second edge define a width of the blade between them, the width is orthogonal to the span, the first edge and the second edge are offset with respect to the face of the blade, and when in use, the first edge is positioned upstream from the second edge.

5. A blade as claimed in claim 4, wherein the first edge is connected to the first extremity of the blade tip and the second edge is connected to the second extremity of the blade tip.

6. A blade as claimed in claim 4, wherein said blade tip is twisted towards the second surface from a centre of gravity of the blade to the first edge, the centre of gravity being disposed midway of the chord of the blade.

7. A blade as claimed in claim 4, wherein said blade tip is twisted towards the first surface from a centre of gravity of the blade to the second edge, the centre of gravity being disposed midway of the chord of the blade.

8. A blade as claimed in claim 1, wherein the blade has a plurality of airfoil shaped cross-sections, and centres of gravity of the plurality of airfoil shaped cross-sections are collinear and runs through a middle of the blade over the entire span of the blade.

9. A method for making a blade for a compressor rotor, the blade having a first edge and a second edge spaced apart along a chord of the blade, the blade having a first end and a second end spaced apart along a span of the blade, the method comprising:

twisting a first segment of the blade in a first direction over an area of the blade disposed at up to 20% of the span from the second end, and twisting a second segment of the blade in a second direction over the area of the blade disposed at up to 20% of the span of the blade from the second end of the blade, the first segment extending from the first edge to a first position along the chord and the second segment extending from the second edge to a second position along the chord, the first segment defining a positive dihedral angle at the second end and the second segment defining a negative dihedral angle at the second end relative to a face of the blade, resulting in forming a split dihedral twist at a blade tip region relative to a conventional rotor blade, wherein the blade is defined by the conventional rotor blade along the entire span outside of the blade tip region.

10. The method of claim 9, further comprising: forming an attachment at the blade root region to attach the blade to the rotor.

11. The method of claim 9, wherein the first position and the second position are a same position.

12. A compressor rotor comprising:

a plurality of blades, at least one of the plurality of blades including:

a blade root at a first end of the at least one of the plurality of blades connectable to the compressor rotor; and a blade tip at a second end of the at least one of the plurality of blades, a span of the at least one of the plurality of blades extends between the first end and the second end, the first end and the second end defining a face of the blade between them, the face extending chordally between a first extremity and an opposite second extremity along a chord of the blade, the blade tip extending up to 20% of the span from the second end towards the first end, a first segment of the blade tip extending from the first extremity to a first position along the chord, a second segment extending from the second extremity to a second position along the chord, the first segment defining a positive dihedral angle at the second end and the second segment defining a negative dihedral angle at the second end relative to the face of the blade, the positive and negative dihedral angles defining a split dihedral twist relative to a conventional rotor blade, wherein the at least one of the plurality of blades is defined by the conventional rotor blade long the entire span outside of the blade tip.

13. A compressor rotor as claimed in claim 12, wherein the first position and the second position are a same position.

14. A compressor rotor as claimed in claim 12, wherein the face of the at least one of the plurality of blades includes a first surface and a second opposed surface, the first surface is convex shaped and the second surface is concave shaped.

15. A compressor rotor as claimed in claim 14, wherein the face of the at least one of the plurality of blades includes a first edge and a second edge, the first edge and the second edge define a width of the at least one of the plurality of blades between them, the width is orthogonal to the span, the first edge and the second edge are offset with respect to the face of the at least one of the plurality of blades, and when in use, the first edge is positioned upstream from the second edge.

16. A compressor rotor as claimed in claim 15, wherein the first edge is connected to the first extremity of the blade tip and the second edge is connected to the second extremity of the blade tip.

17. A compressor rotor as claimed in claim 15, wherein said blade tip is twisted towards one of the first surface and the second surface from a centre of gravity of the blade to the first edge, the centre of gravity being disposed midway of a chord of the blade.

18. A compressor rotor as claimed in claim 12, wherein the at least one of the plurality of blades has a plurality of airfoil shaped cross-sections, and centres of gravity of the plurality of airfoil shaped cross-sections are collinear and runs through a middle of the at least one of the plurality of blades over the entire span of the at least one of the plurality of blades.

* * * * *